US007584803B2

(12) United States Patent
Ballard

(10) Patent No.: US 7,584,803 B2
(45) Date of Patent: Sep. 8, 2009

(54) SPRINKLER WITH MOTION LIMITED LEVER

(75) Inventor: Robert J. Ballard, Whitehall, PA (US)

(73) Assignee: Victaulic Company, Easton, PA (US)

( * ) Notice: Subject to any disclaimer, the term of this patent is extended or adjusted under 35 U.S.C. 154(b) by 441 days.

(21) Appl. No.: 11/385,562

(22) Filed: Mar. 21, 2006

(65) Prior Publication Data

US 2007/0221389 A1 Sep. 27, 2007

(51) Int. Cl.
*A62C 37/08* (2006.01)
*A62C 37/36* (2006.01)

(52) U.S. Cl. ..... 169/40; 169/37; 169/41; 169/42

(58) Field of Classification Search ..... 169/37, 169/38, 39, 40, 41, 42; D23/214, 213
See application file for complete search history.

(56) References Cited

U.S. PATENT DOCUMENTS

| | | | | | |
|---|---|---|---|---|---|
| 433,477 | A | * | 8/1890 | Lapham | 169/39 |
| 488,257 | A | * | 12/1892 | Swan | 169/39 |
| 537,552 | A | * | 4/1895 | Swan | 169/39 |
| 585,128 | A | * | 6/1897 | Steck | 169/39 |
| 585,130 | A | * | 6/1897 | Steck | 169/39 |
| 591,266 | A | * | 10/1897 | Bishop | 169/39 |
| 634,457 | A | * | 10/1899 | Hoffmann | 169/39 |
| 717,272 | A | * | 12/1902 | Ray | 169/38 |
| 770,753 | A | * | 9/1904 | Hunt | 169/39 |
| 770,755 | A | * | 9/1904 | Hunt | 169/39 |
| 807,205 | A | * | 12/1905 | Rockwood | 169/39 |
| 868,459 | A | | 10/1907 | Lewis | |
| 897,908 | A | * | 9/1908 | Lapham | 169/40 |
| 951,339 | A | * | 3/1910 | Rockwood | 169/39 |
| 990,780 | A | * | 4/1911 | Rockwood | 169/39 |
| 1,028,940 | A | * | 6/1912 | Hunter | 169/39 |
| 1,107,845 | A | * | 8/1914 | Sackett | 169/37 |
| 1,236,901 | A | * | 8/1917 | Blauvelt | 169/39 |
| 1,281,606 | A | * | 10/1918 | Loepsinger | 169/39 |
| 1,808,684 | A | * | 6/1931 | Rowley | 137/72 |
| 2,101,694 | A | | 12/1937 | Tyden | 299/121 |
| 2,348,152 | A | * | 5/1944 | Rowley | 169/39 |
| 2,357,227 | A | * | 8/1944 | Rowley | 169/39 |
| 2,370,243 | A | * | 2/1945 | Henshaw | 169/39 |

(Continued)

OTHER PUBLICATIONS

International Search Report, mailed Jan. 15, 2008, International Application No. PCT/US07/05044.

*Primary Examiner*—Robin O Evans
*Assistant Examiner*—Daniel T Sharpe
(74) *Attorney, Agent, or Firm*—Ballard Spahr Andrews and Ingersoll, LLP

(57) ABSTRACT

A sprinkler of the compressed strut and lever type wherein the motion of the lever is limited is disclosed. The sprinkler includes a compression member that compresses a strut against a sealing member that closes the outlet of the sprinkler. One end of a lever is positioned between the compression member and the strut. The opposite end is positioned in proximity to an abutment surface on the sprinkler. The opposite end is engageable with the abutment surface which limits motion of the lever and maintains an offset between the strut and the compression member that renders the strut and lever an unstable mechanism. A frangible link extends between the strut and the lever. The link separates in response to an increase in temperature indicative of a fire condition.

19 Claims, 5 Drawing Sheets

U.S. PATENT DOCUMENTS 2,375,832 A * 5/1945 Tyden ..... 169/39
2,736,386 A 2/1956 Klompar ..... 169/4
3,195,647 A * 7/1965 Campbell et al. ..... 169/40
3,291,216 A 12/1966 Merrill ..... 169/39
3,314,482 A * 4/1967 Young ..... 169/38
3,336,984 A * 8/1967 Macartney ..... 169/38
3,561,537 A * 2/1971 Dix et al. ..... 169/38
3,590,924 A 7/1971 Emmons et al. ..... 169/17
3,682,251 A * 8/1972 Livingston ..... 169/37
3,866,686 A * 2/1975 Goodsell et al. ..... 169/39
4,091,872 A * 5/1978 Mountford ..... 169/37
4,136,740 A * 1/1979 Groos et al. ..... 169/39
4,176,718 A * 12/1979 Vorkapich ..... 169/39
4,273,195 A 6/1981 Fischer et al.
4,279,309 A 7/1981 Fischer et al. ..... 169/37
4,405,018 A * 9/1983 Fischer ..... 169/37
4,436,159 A 3/1984 Revay ..... 169/28
4,577,544 A 3/1986 Lee ..... 89/1.14
4,585,069 A * 4/1986 Whitaker ..... 169/37
4,623,023 A 11/1986 Retzloff et al. ..... 169/39
4,732,216 A 3/1988 Polan ..... 169/38
4,757,865 A 7/1988 Simons
4,893,679 A * 1/1990 Martin et al. ..... 169/39
4,901,799 A * 2/1990 Pepi et al. ..... 169/39
4,930,578 A * 6/1990 Barnett et al. ..... 169/39
4,986,364 A 1/1991 Clark ..... 169/48
4,987,957 A 1/1991 Galaszewski ..... 169/37
5,890,657 A * 4/1999 Ponte ..... 239/518
6,059,044 A 5/2000 Fischer
6,336,510 B1 * 1/2002 Gadini ..... 169/37
6,446,732 B1 9/2002 Polan ..... 169/37
6,450,265 B1 * 9/2002 Ponte ..... 169/37
6,585,054 B1 * 7/2003 Thomas et al. ..... 169/37
6,976,543 B1 * 12/2005 Fischer ..... 169/37
7,036,603 B2 * 5/2006 Thomas et al. ..... 169/37
7,137,455 B2 * 11/2006 Green ..... 169/37
7,165,624 B1 * 1/2007 Fischer ..... 169/37
7,237,619 B2 * 7/2007 Mehr ..... 169/37
7,290,618 B2 * 11/2007 Thomas et al. ..... 169/42
2003/0201105 A1 10/2003 Thomas et al. ..... 169/37

* cited by examiner

FIG. 3
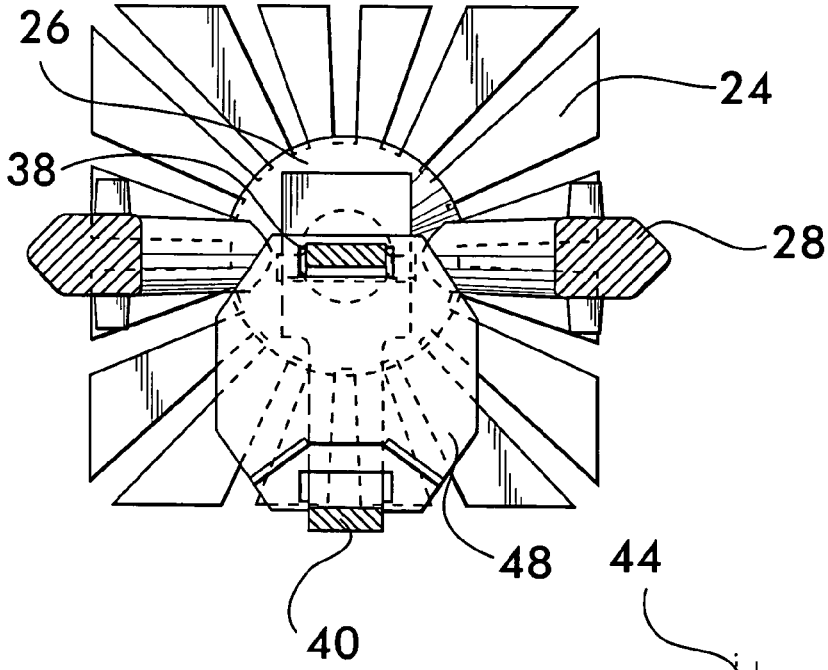
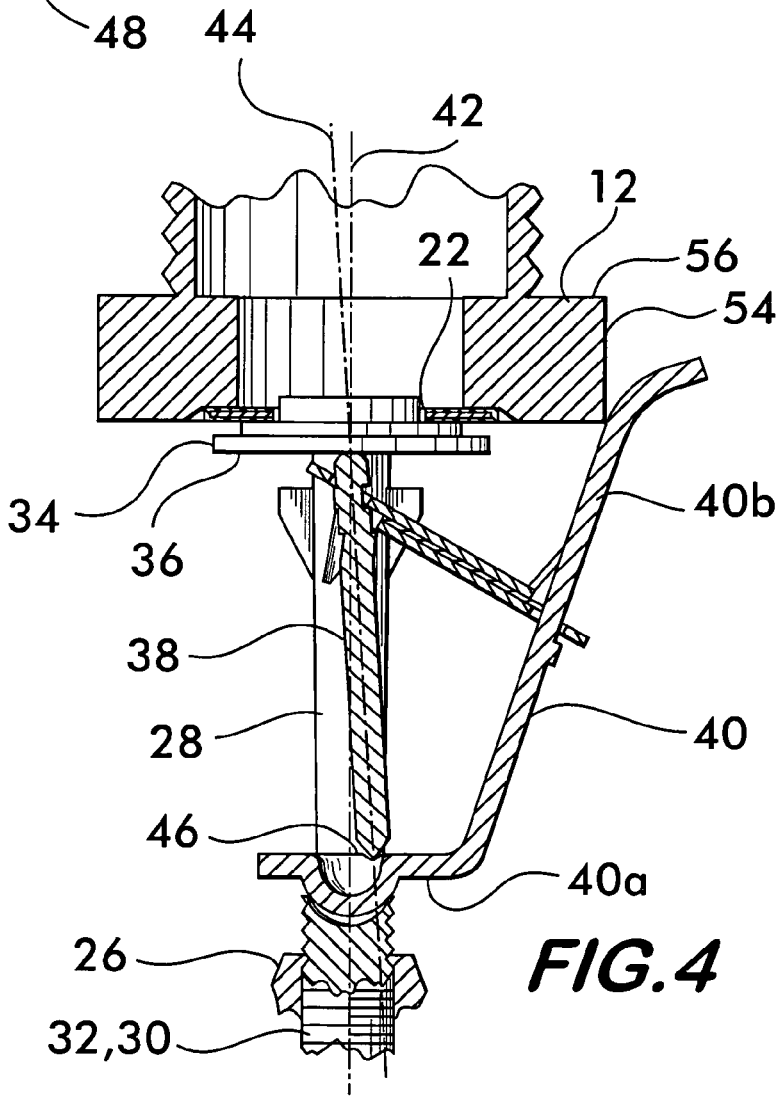
FIG. 4

SPRINKLER WITH MOTION LIMITED LEVER

FIELD OF THE INVENTION

This invention relates to sprinklers for fire suppression systems having compressed lever and strut triggering mechanisms.

BACKGROUND OF THE INVENTION

Of the various types of sprinklers used in fire suppression systems, the compressed lever and strut variety finds extensive use. Compressed lever and strut sprinklers use an inherently unstable trigger mechanism comprising a compression member that compresses a strut and lever against a sealing member which closes the outlet of the sprinkler. The strut is positioned lengthwise between the compression member and the sealing member, and the lever is positioned between an end of the strut and the compression member. The strut has a line of action that is offset from the line of action of the compression member. This offset allows the compression member to induce a torque in the lever, which, if unrestrained, would rotate away from the strut, causing the strut to disengage from between the compression member and the sealing member and allow the sprinkler to open. A frangible link extends between the strut and the lever, normally preventing rotation of the lever. The link separates in response to an increase in the ambient temperature indicative of a fire, thereby allowing the lever to rotate and displace the strut from between the compression member and the sealing member, releasing the sealing member and opening the outlet. Fire suppressing liquid may then flow through the sprinkler to contain and extinguish the fire.

For proper functioning of the sprinkler, the trigger mechanism must remain unstable. It is observed however, that a force applied to the free end of lever tending to move the end toward the strut will shift the line of action of the strut, causing it to align with the line of action of the compression member. When this occurs, the mechanism becomes stable, there is no torque on the lever and the link is no longer under tension and is not needed to hold the lever in position. When a temperature increase from a fire causes the link separate, the strut and the lever remain in position between the compression member and the sealing member, holding the sealing member in position closing the sprinkler outlet. In this situation, the sprinkler fails to open and discharge water and the fire propagates. The force applied to the lever which renders the trigger mechanism stable may occur as a result of improper handling during shipping or installation. The mechanism may also be rendered stable due to improper assembly at the factory. It is, furthermore, very difficult to visually detect whether a trigger mechanism is in a stable or an unstable condition. There is clearly a need for an improved sprinkler of the compressed lever and strut type which does not suffer from this disadvantage.

SUMMARY OF THE INVENTION

The invention concerns a sprinkler for a piping network of a fire suppression system. The sprinkler comprises a body having an inlet connectable to the piping network and an outlet in fluid communication with the inlet. A compression member is mounted on the body and is positioned in facing relation with the outlet. The compression member has a first line of action extending toward the outlet. A sealing member closes the outlet. A strut extends lengthwise between the compression member and the sealing member. The strut has a second line of action that is offset from the first line of action of the compression member. A lever has a first portion that is positioned between the strut and the compression member. The lever also has a second portion spaced from the first portion. The body has an abutment surface engageable with the second portion of the lever. Engagement of the second portion with the abutment surface limits motion of the lever toward the strut so as to maintain the offset between the first and second lines of action of the strut and the compression member. A link attaches the lever to the strut. The link is frangible, and when heated to a predetermined temperature, releases the lever from the strut. The strut thereby disengages from the sealing member, allowing the sealing member to disengage from the outlet to permit fluid flow from the sprinkler.

The invention also includes a fire suppression system comprising a piping network to which one or more of the above described to sprinklers are attached.

The invention further includes a method of maintaining an offset between a first line of action of a compression member and a second line of action of a strut. The method comprises:

(A) providing a lever;

(B) positioning a portion of the lever between the strut and the compression member;

(C) compressing the lever between the compression member and the strut;

(D) providing a link between the lever and the strut, the link preventing motion of the lever away from the strut;

(E) providing an abutment surface engageable with the lever, the abutment surface limiting motion of the lever toward the strut.

BRIEF DESCRIPTION OF THE DRAWINGS

FIG. 3 is a cross sectional view of the sprinkler embodiment taken at line 3-3 in FIG. 1;

FIG. 4 is a longitudinal sectional view of another embodiment of the sprinkler according to the invention;

DETAILED DESCRIPTION OF THE EMBODIMENTS

Figure 1:
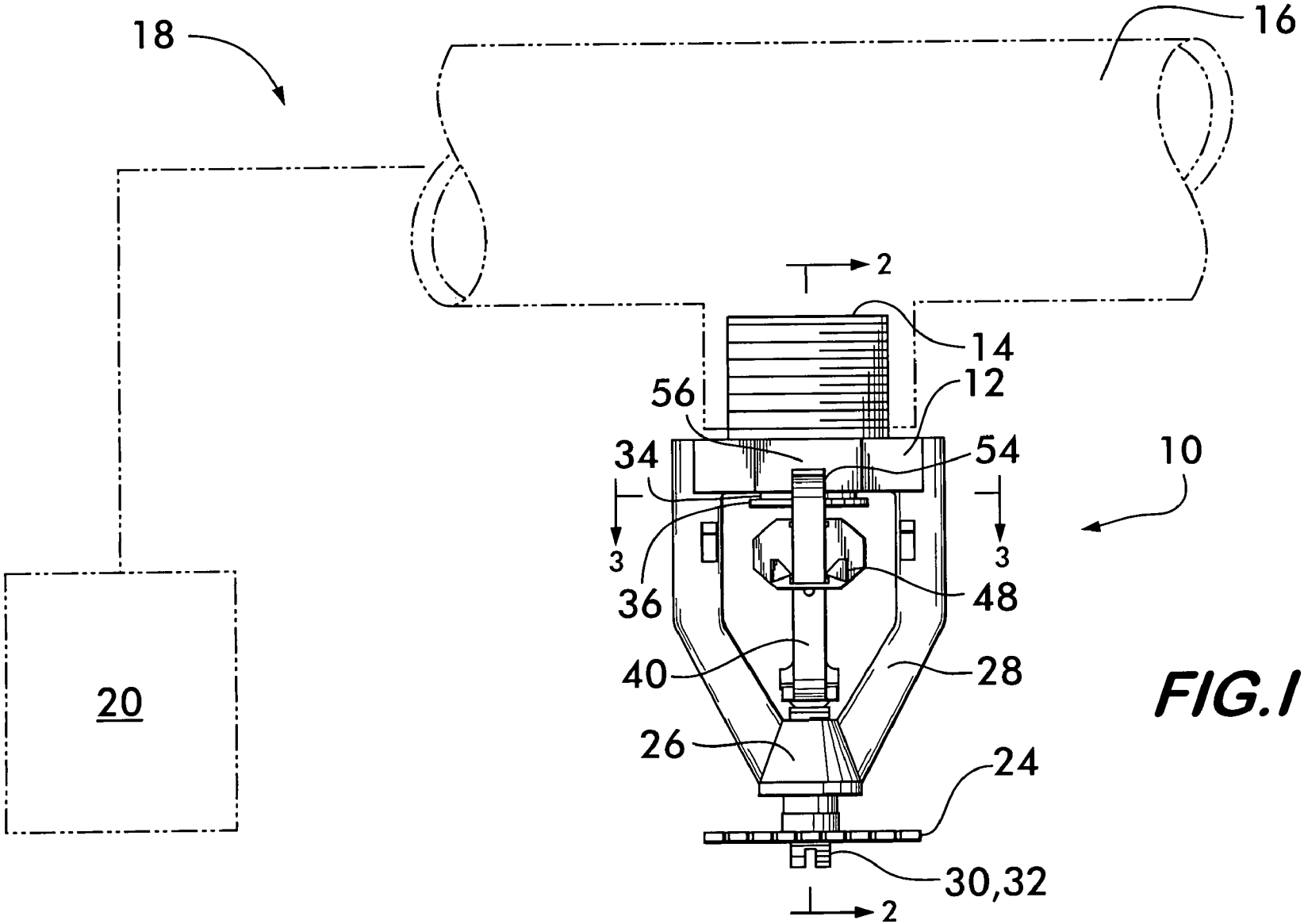
FIG. 1 is a side view of a sprinkler embodiment according to the invention in a fire suppression system.

FIG. 1 shows a sprinkler 10 according to the invention. Sprinkler 10 comprises a body 12 having an inlet 14 threadably connected to a piping network 16 of a fire suppression system 18. The piping network conducts water or other fire suppressing fluid from a source of pressurized fluid 20 to the sprinkler, which opens in the event of a fire to extinguish the fire and prevent its propagation.

Figure 2:
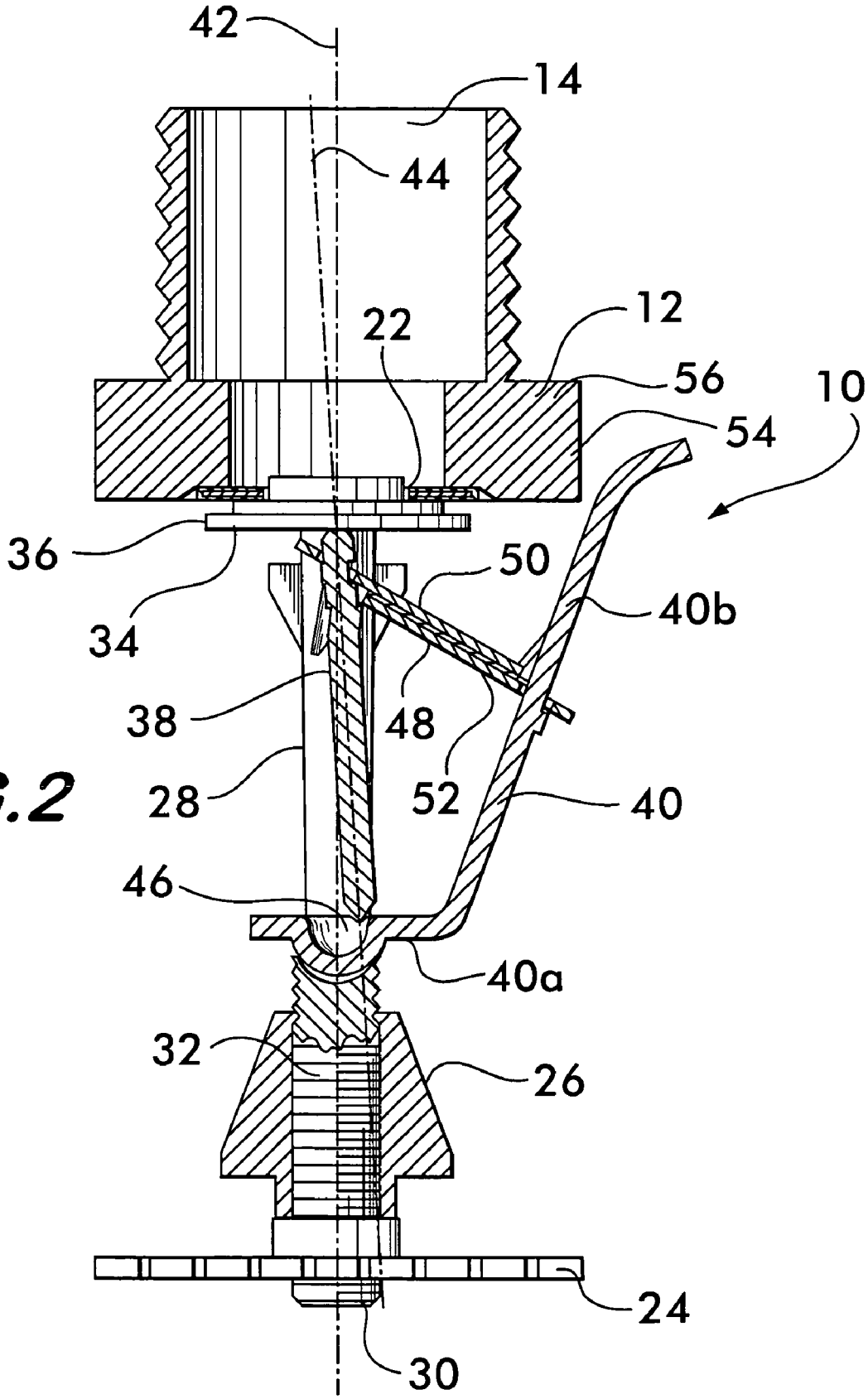
FIG. 2 is a longitudinal sectional view of the sprinkler embodiment taken at line 2-2 of FIG. 1.

As best shown in FIG. 2, body 12 has an outlet 22 in fluid communication with inlet 14. The outlet faces a deflector plate 24 mounted on a housing 26 supported by legs 28 that extend from body 12. Housing 26 receives a compression member 30, for example, a threaded stud 32 that engages internal threads within the housing and is thus movable toward and away from the outlet 22 upon rotation of the stud.

A sealing member 34, for example, disk 36, closes outlet 22. The sealing member 34 is held in position by a strut 38 that is compressed against the sealing member by the compression member 30 acting in conjunction with a lever 40. Lever 40 has a first portion 40*a* positioned between one end of strut 38 and the compression member 30, the opposite end of the strut engaging the sealing member 34. Note that the strut and the lever are both separate components which are not fixed to each other, the sealing member, or the compression member.

Compression member 30 has a line of action 42, corresponding substantially to the centerline of the threaded stud 32. Similarly, strut 38 has a line of action 44 which generally corresponds to the strut centerline. The strut line of action 44 is offset in relation to the line of action 42 of the compression member 30. The offset may comprise an angular offset 46 as shown, effected by angularly orienting the strut 38 relatively to the compression member 30. When the compression member is advanced, the lever portion 40*a* is compressed against the strut 38 and the strut is compressed against the sealing member 34 (disk 36 in this example). Because there is an offset 46 between the lines of action of the compression member 30 and the strut 38, the compression force induces a torque on lever 40. The strut 38 is offset toward the lever 40 such that the torque acts to rotate the lever outwardly away from the strut.

Another portion 40*b* of the lever 40 is in spaced relation away from end 40*a*. Lever portion 40*b* preferably extends upwardly alongside strut 38 to permit a link 48 to extend between the strut and the lever. Link 48 is shown in detail in FIG. 3. As best shown in FIG. 2, link 48 is formed by two plates 50 and 52 soldered to each other in facing relation using a solder with a predetermined melting temperature. One of the plates, 50, engages the strut, the other, 52, engages the lever. As long as the solder joint remains intact, link 48 prevents lever 40 from rotating outwardly away from the strut 38 under the torque induced by the compression of the lever and the strut by the compression member 30.

In operation, with the sprinkler 10 mounted on the piping network 16 as shown in FIG. 1, the lever 40 is subjected to torque but is prevented from rotating by link 48, which is under tension. During a fire, when the ambient temperature surrounding the sprinkler 10 reaches the melting point of the solder holding the plates 50 and 52 of the link 48 together (see FIG. 2), the solder melts. The link can no longer withstand the tension, the plates separate and the torque on lever 40 causes it to rotate outwardly away from strut 38. Upon rotation of the lever, the strut 38 is dislodged and falls away from the sprinkler, no longer supporting sealing member 34, which falls away from the outlet thereby allowing water or other fire suppressing fluid to be discharged from the sprinkler head.

The lever 40 and strut 38, when compressed between the compression member 30 and the sealing member 34, constitute an unstable trigger mechanism held in place by the separable link 48. The instability is due to the offset 46 of the line of action 44 of the strut 38 relatively to the line of action 42 of the compression member 30 which causes a torque to be induced on the lever by the applied compression force. For proper functioning of the sprinkler 10 the mechanism must remain unstable. It is observed, however, that a force applied to the end 40*b* of lever 40 tending to move the end 40*b* toward the strut 38 will shift the line of action 44 of the strut, causing it to align with the line of action 42 of the compression member 34. If this is permitted to occur the mechanism becomes stable, there is no torque on the lever, and the link 48 is no longer under tension. When a temperature increase from a fire causes the solder holding the plates 50 and 52 of the link to melt, the plates separate but the lever and the strut remain in position between the compression member and the sealing member, holding the sealing member 34 in position closing outlet 22. In this situation, the sprinkler 10 fails to open and discharge water and the fire propagates.

To prevent the trigger mechanism from becoming stable, the body 12 has an abutment surface 54. Abutment surface 54 is located between the strut 38 and the end 40*b* of lever 40, and these two elements are mutually positioned to cooperate with one another and limit the motion of lever 40 toward the strut 38. In the example embodiment shown in FIG. 1, the lever 40 extends angularly from end 40*a* so as to position opposite end 40*b* in close proximity to the abutment surface 54, which comprises a flat 56 on the body 12 adjacent to the outlet 22. The lever end 40*b* may be in spaced relation to the abutment surface as shown in FIG. 2, or it may be in contact with the surface, as shown in FIG. 4.

Figure 5:
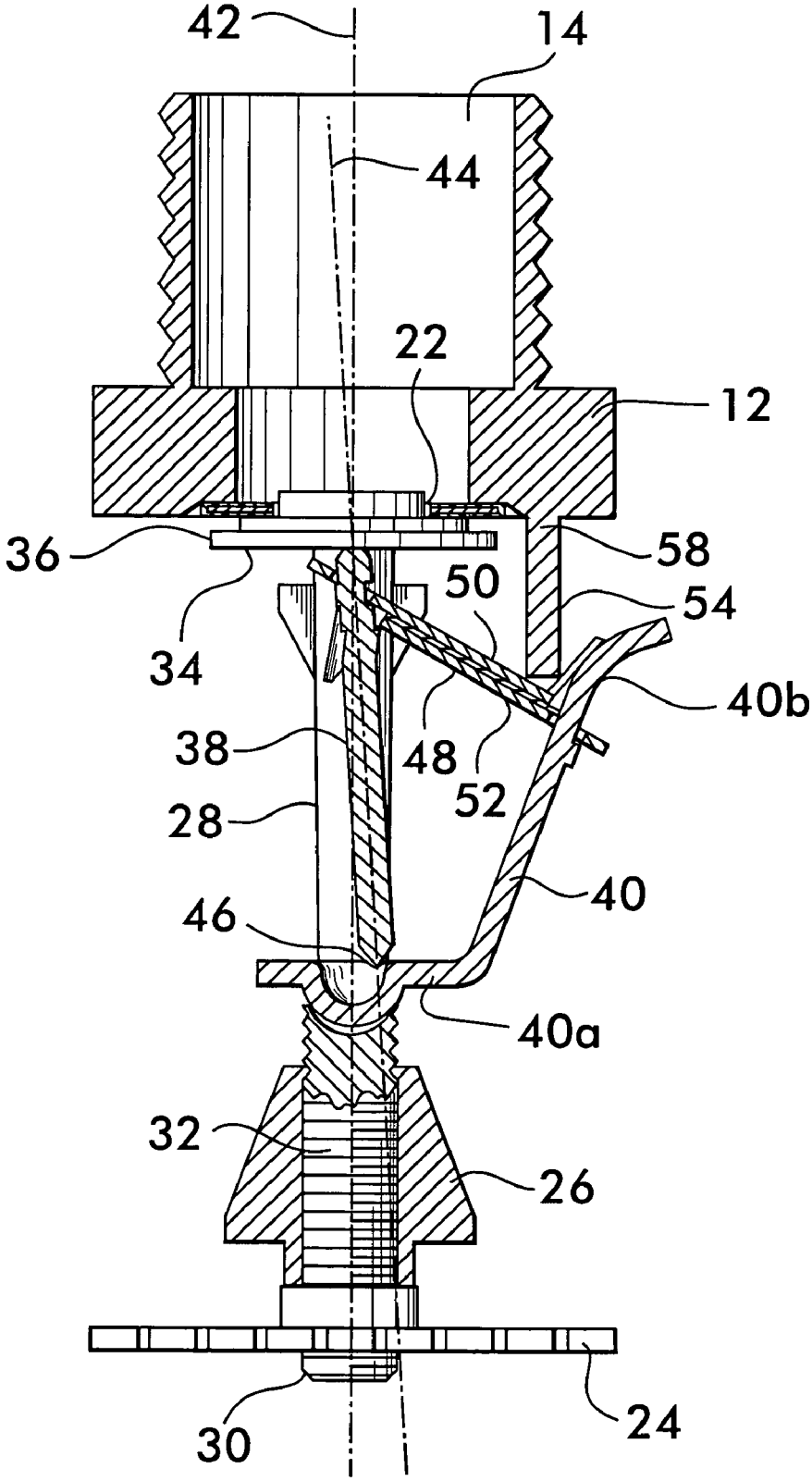
FIG. 5 is a longitudinal sectional view of another embodiment of the sprinkler according to the invention.
Figure 6:
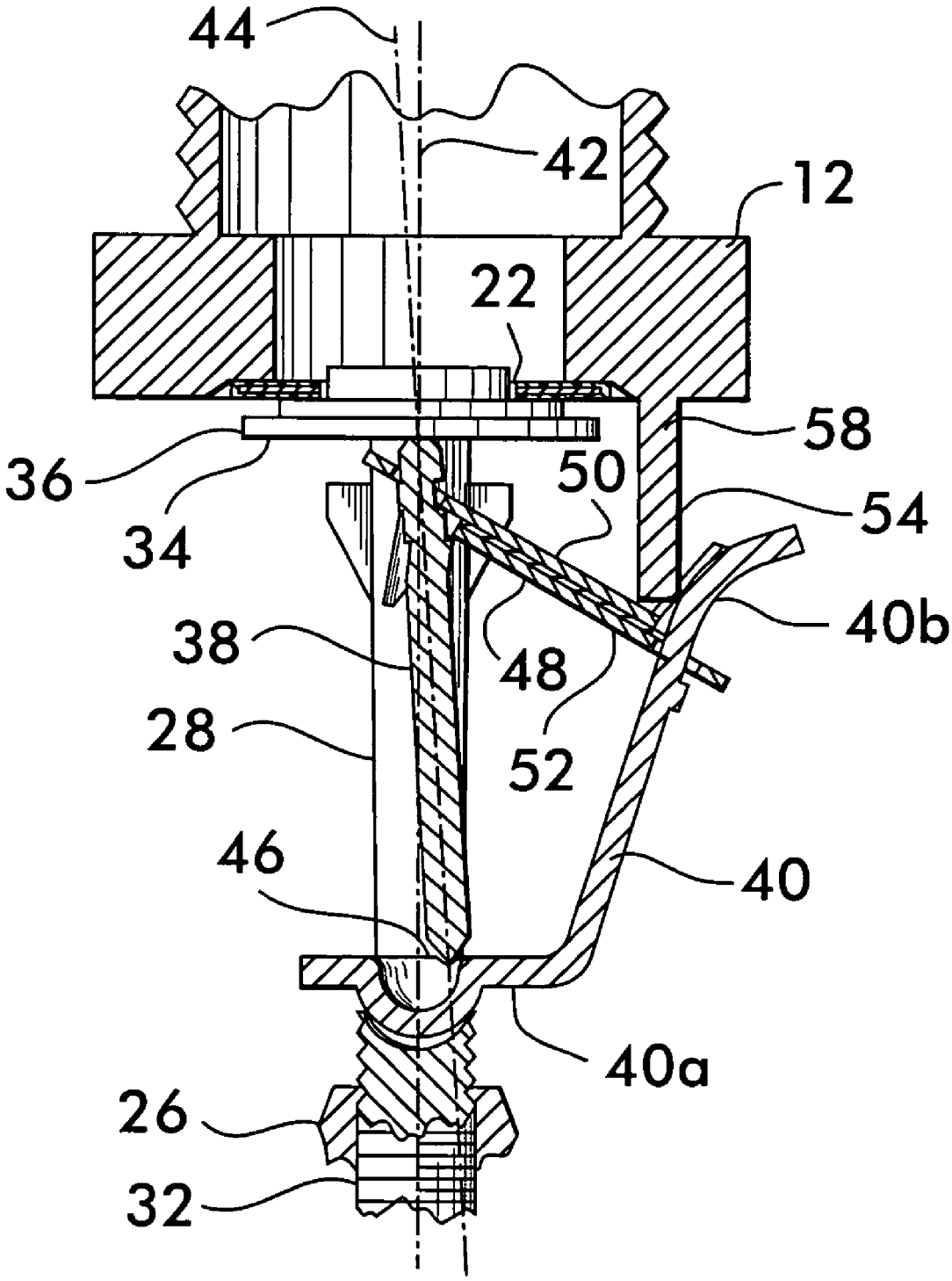
FIG. 6 is a longitudinal sectional view of another embodiment of the sprinkler according to the invention.

In another embodiment, shown in FIG. 5, the abutment surface 54 may be located on a projection 58 that extends from the body 12. The projection 58 allows a shorter lever 40 to be used but still allows cooperation between the components to limit lever motion and ensure mechanism instability. The lever end 40*b* may be in spaced relation to the abutment as shown in FIG. 5, or in contact with it, as shown in FIG. 6.

Use of the abutment surface in cooperation with the lever limits motion of the lever so as to avoid shifting of the line of action of the strut which might otherwise eliminate the offset necessary to the proper functioning of the sprinkler. Additionally, the abutment surface will facilitate assembly of the trigger mechanism as it provides a positive stop for ensuring proper positioning of the lever relatively to the strut.

Sprinklers of the compressed lever and strut type further having an abutment surface engageable with the lever according to the invention provide a more reliable sprinkler which will not become inoperative due to improper assembly or handling during shipping and installation.

What is claimed is:

1. A sprinkler for a piping network of a fire suppression system, said sprinkler comprising:

a body having an inlet connectable to said piping network and an outlet in fluid communication with said inlet;

a compression member mounted on said body and positioned in facing relation with said outlet, said compression member having a first line of action extending toward said outlet;

a sealing member for closing said outlet;

a strut extending lengthwise between said compression member and said sealing member, said strut having a second line of action offset from said first line of action;

a lever having a first portion positioned between said strut and said compression member and a second portion spaced from said first portion, said body having an abutment surface, said second portion of said lever being engageable with said abutment surface when said first portion of said lever is positioned between said strut and said compression member for limiting motion of said lever so as to maintain said offset between said first and second lines of action; and a link attaching said lever to said strut, said link being frangible when heated to a predetermined temperature and releasing said lever from said strut, said strut thereby disengaging from said sealing member, said sealing member opening said outlet to permit fluid flow therefrom.

2. A sprinkler according to claim 1, wherein said first and second lines of action are angularly offset from one another.

3. A sprinkler according to claim 1, further including a projection extending outwardly from said body, said projection being positioned between said strut and said lever, said abutment surface being located on said projection.

4. A sprinkler according to claim 1, wherein said link comprises a pair of plates joined in facing relation by a solder having a predetermined melting point, one of said plates engaging said lever, the other of said plates engaging said strut.

5. A sprinkler according to claim 1, wherein said compression member comprises a threaded stud positioned within a threaded housing mounted on a pair of arms extending from said body.

6. A sprinkler for a piping network of a fire suppression system, said sprinkler comprising:

a body having an inlet connectable to said piping network and an outlet in fluid communication with said inlet;

a compression member mounted on said body and positioned in facing relation with said outlet, said compression member being adjustably movable toward and away from said outlet;

a sealing member for closing said outlet;

a strut extending lengthwise between said compression member and said sealing member, said strut being angularly offset from the centerline of said compression member;

a lever having a first portion positioned between said strut and said compression member and a second portion spaced from said first portion, said body having an abutment surface, said second portion of said lever being engageable with said abutment surface when said first portion of said lever is positioned between said strut and said compression member for limiting motion of said lever so as to maintain said offset between said strut and center line of said compression member; and a link attaching said lever to said strut, said link being frangible when heated to a predetermined temperature and releasing said lever from said strut, said strut thereby disengaging from said sealing member, said sealing member opening said outlet to permit fluid flow therefrom.

7. A sprinkler according to claim 6, further including a projection extending outwardly from said body, said projection being positioned between said strut and said lever, said abutment surface being located on said projection.

8. A sprinkler according to claim 6, wherein said link comprises a pair of plates joined in facing relation by a solder having a predetermined melting point, one of said plates engaging said lever, the other of said plates engaging said strut.

9. A sprinkler according to claim 6, wherein said compression member comprises a threaded stud positioned within a threaded housing mounted on a pair of arms extending from said body.

10. A fire suppression system, comprising:

a piping network connected to a pressurized source of a fire suppressing fluid;

at least one sprinkler connected to said piping network, said sprinkler being normally closed and opening in response to an increase to a predetermined temperature indicative of a fire condition, said sprinkler comprising:

a body having an inlet in fluid communication with said piping network and an outlet in fluid communication with said inlet;

a compression member mounted on said body and positioned in facing relation with said outlet, said compression member having a first line of action extending toward said outlet;

a sealing member closing said outlet;

a strut extending lengthwise between said compression member and said sealing member, said strut having a second line of action offset from said first line of action;

a lever having a first portion positioned between said strut and said compression member and a second portion spaced from said first portion, said body having an abutment surface, said second portion of said lever being engageable with said abutment surface when said first portion of said lever is positioned between said strut and said compression member for limiting motion of said lever so as to maintain said offset between said first and second lines of action; and link attaching said lever to said strut, said link being frangible when heated to said predetermined temperature and releasing said lever from said strut, said strut thereby disengaging from said sealing member, said sealing member opening said outlet to permit fluid flow from said reservoir through said piping network and through said outlet.

11. A fire suppression system according to claim 10, wherein said first and second lines of action are angularly offset from one another.

12. A fire suppression system according to claim 10, further including a projection extending outwardly from said body, said projection being positioned between said strut and said lever, said abutment surface being located on said projection.

13. A fire suppression system according to claim 10, wherein said link comprises a pair of plates joined in facing relation by a solder having a predetermined melting point, one of said plates engaging said lever, the other of said plates engaging said strut.

14. A fire suppression system according to claim 10, wherein said compression member comprises a threaded stud positioned within a threaded housing mounted on a pair of arms extending from said body.

15. A fire suppression system according to claim 10, further comprising a plurality of said sprinklers.

16. A sprinkler for a piping network of a fire suppression system, said sprinkler comprising:

a body having an inlet connectable to said piping network and an outlet in fluid communication with said inlet;

a compression member mounted on said body and positioned in facing relation with said outlet, said compression member having a first line of action extending toward said outlet;

a sealing member for closing said outlet;

a strut extending lengthwise between said compression member and said sealing member, said strut having a second line of action offset from said first line of action;

a lever having a first portion positioned between said strut and said compression member and a second portion spaced from said first portion;

an abutment surface positioned on said body between said lever and said strut, said second portion of said lever being positioned to engage said abutment surface when said first portion of said lever is positioned between said strut and said compression member for limiting motion of said lever so as to maintain said offset between said first and second lines of action; and a link attaching said lever to said strut, said link being frangible when heated to a predetermined temperature and releasing said lever from said strut, said strut thereby disengaging from said sealing member, said sealing member opening said outlet to permit fluid flow therefrom.

17. A sprinkler according to claim 16, wherein said second portion of said lever is in contact with said abutment surface.

18. A sprinkler according to claim 16, wherein said second portion of said lever is in spaced relation to said abutment surface.

19. A sprinkler according to claim 16, further including a projection extending outwardly from said body, said projection being positioned between said strut and said lever, said abutment surface being located on said projection.

* * * * *